United States Patent [19]

Chi

[11] Patent Number: 4,644,962

[45] Date of Patent: Feb. 24, 1987

[54] MULTI-PURPOSE CIGARETTE PIPE

[76] Inventor: Kyung D. Chi, 481 Rollins Rd., Burlingame, Calif. 94010

[21] Appl. No.: 659,834

[22] Filed: Oct. 11, 1984

[51] Int. Cl.[4] ..... A24F 7/00; A24F 13/18

[52] U.S. Cl. ..... 131/174; 131/175; 131/256

[58] Field of Search ..... 131/174, 256, 175

[56] References Cited

U.S. PATENT DOCUMENTS

| | | | |
|---|---|---|---|
| 2,900,987 | 8/1959 | Campbell | 131/256 |
| 3,765,427 | 10/1973 | Bell | 131/174 |
| 4,413,638 | 11/1983 | Le | 131/174 |

FOREIGN PATENT DOCUMENTS

| | | | |
|---|---|---|---|
| 1211758 | 11/1970 | United Kingdom | 131/174 |

*Primary Examiner*—V. Millin

[57] ABSTRACT

A cigarette pipe having means of lighting the cigarette for smoking, receiving ashes, extracting nicotine while smoking and extinguishing cigarette light when finished smoking. The pipe includes a cigarette lighter, an ash tray, a cigarette holder/light extinguisher and a nicotine extractor. The pipe is designed for safely and conveniently smoking a cigarette and to prevent accidental fires caused by cigarette smoking. The lighter is attached to the head of the pipe so as to light the cigarette by simply pushing the button. The ash tray is formed at the bottom of the main body and collects ashes while smoking. The cigarette holder/light extinguisher holds the cigarette in proper position for smoking and also extinguishes cigarette light when the burning ember of the cigarette reaches the holder.

2 Claims, 5 Drawing Figures

MULTI-PURPOSE CIGARETTE PIPE

BACKGROUND OF THE INVENTION

Figure 1:
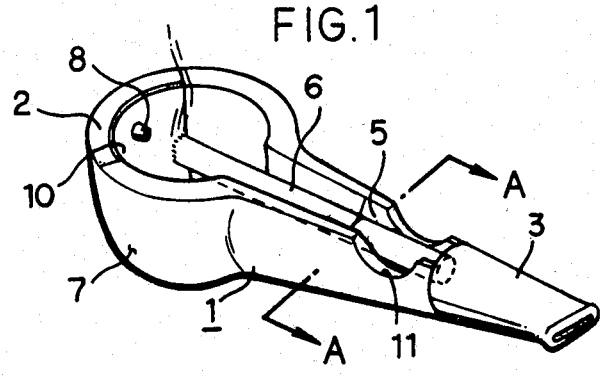

This invention is related to a device smoking a cigarette and more particularly to a cigarette pipe having means of lighting the cigarette, receiving ashes, extinguishing cigarette light and extracting cigarette tar and nichotine. The present invention obviates the need of preparing separate ash tray or lighter for smoking cigarettes and prevents accidental fire caused by cigarette smoking.

Heretofore, there have been various types of cigarette holders in combination with ash tray and lighter. These holders are described in U.S. Pat. Nos. 3,173,425 to Gregory, 3,765,427 to Bell, 4,413,638 to Kans and British Pat. No. 1 211 758 to Ginelli. Of these prior arts, the U.S. Pat. No. 4,413,638 and British Pat. No. 1 211 758 are more closely related to the present invention. However, these prior arts are comprised of many separate pieces of parts therefore naturally result in complicated in design, expensive to manufacture, inefficient in operation and inconvenience in use. More particulary, these prior arts places more emphasis on the storage of ashes and butts and adopted the system to supply air into the holder or discard smoke from the holder through numerous small perforations or a tube. In this manner smooth combustion of cigarette may be jeoparadized due to the insufficient amount of oxygen or excess amount of smoke in the holder. Also, cigarette tars and nichotines will adhere to the walls of perforations or tube and requires special cleaning of the holder.

SUMMARY OF INVENTION

The subject cigarette pipe is designed for safely and conveniently smoking cigarettes or the like. It prevents ashes being dropped while smoking and also prevents accidental fire caused by smoking cigarettes. The cigarette placed within the pipe for smoking is lighted by simply pushing the button of the lighter attached thereto. The cigarette pipe may be held in the mouth between teeth or it may be placed on the table or it may be used both as an ash tray and as a pipe. When using the pipe the smoker is free from paying attention to the ashes or putting the cigarette light off.

The cigarette pipe includes a cigarette lighter for lighting the cigarette when to smoke. The lighter is attached to the pipe in a manner that the lighter composes a part of the head of the pipe. The ash tray is formed at the inner bottom of the pipe and automatically collects ashes while smoking. The cigarette holder/light extinguisher is located at the end of the housing and it holds the cigarette in proper position for smoking and extinguishes cigarette light when finished smoking. The nichotine extractor, which is comparable to the conventional cigarette pipe, is attached to the end of the said cigarette holder. The housing is a chamber wherein the cigarette is placed for smoking, and the entire upper portion of the said housing is open so that a cigarette is inserted into the housing therethrough; and, also assures smooth circulation of air and smoke into and out of the housing.

Advantage of the present invention over prior art patents are; (1) Efficiency in operation: The opening at the top of the housing assures easy loading of cigarette into the housing and smooth combustion of cigarette. The cigarette is lighted by simply pushing the button of the lighter. While smoking, ash tray collects ashes and when finished smoking, the cigarette light is extinguished at a preset point of the cigarette automatically. (2) Simple in design and inexpensive to manufacture: The present invention is a single piece of material when in use. The lighter is fixed to the head of the pipe and remaining components, i.e., ash tray, cigarette holder/-light extinguisher, and housing are formed within a single piece of material, the main body. (3) Easy to use and easy to clean: The present invention is so compact and easily held in the mouth between teeth or may be placed on the table for the use both as cigarette pipe and ash tray. Also, the opening at the top of the housing prevents nichotine or tars of cigarette be adhere to the walls of the housing, therefore, assures easy cleaning of the ashes and butts.

The principal objective of the invention is to provide a compact cigarette pipe having means of lighting the cigarette, receiving ashes, extinguishing cigarette light and extracting nichotine of the cigarette.

Another objective of the invention is to provide a pipe having such function stated above and that the pipe is inexpensive to manufacture, efficient in operation, simple in design and convenient in use.

Other objects and advantages of the invention will become evident from the following detailed description of the drawings when read in accordance with the accompanying drawings.

BRIEF DESCRIPTION OF THE INVENTION

Figure 2:
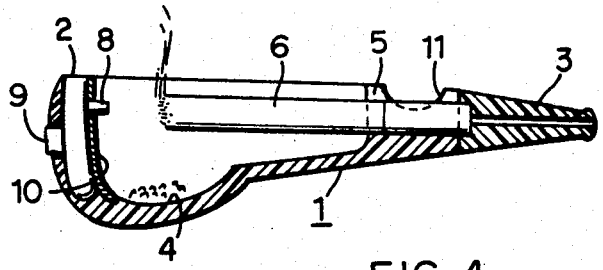
Figure 3:
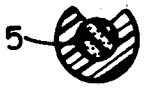
Figure 4:
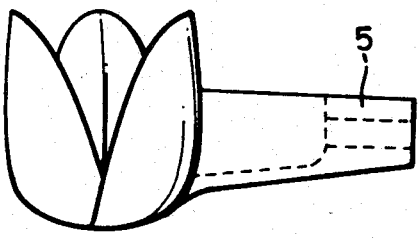
Figure 5:
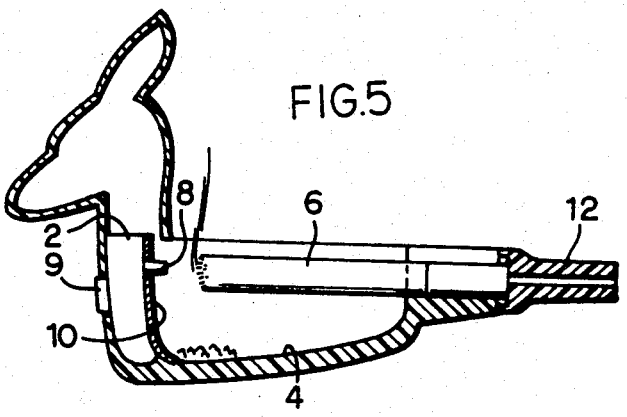

FIG. 1 is a prospect view of the invention, in basic form,

FIG. 2 is a longitudinal view of the invention showing a cigarette is being placed within the housing for smoking, FIG. 3 is a cross sectional view taken on the line A—A of FIG. 1, showing the cigarette holder holding a cigarette, FIG. 4 is a prospect view of the invention, in a shape of flower and with the lighter and nichotine extractor being excluded, and FIG. 5 is a longitudinal view of the invention, in a shape of an animal and with a separately made nichotine extractor being connected to the filter of the cigarette.

Refering to the drawing, the multi-purpose cigarette pipe, in basic form, comprises a main body 1, a cigarette lighter 2, and a nichotine extractor 3. Furthermore, the main body 1 is composed of an ash tray 4, a cigarette holder/light extinguisher 5, a housing 6 and a head 7.

The lighter 2 is attached to the pipe in a manner that the lighter forms a part of the head 7. The lighter 2 is basically the same with a conventional cigarette lighter except that the end of the nozzle 8 is extended into the head 7 pointing toward the end of the cigarette being placed for smoking, and the button 9 is located at the rear of the lighter 2, and also it has a heat preventing plate 10 in front of the gas tank of the lighter 2 to shut off the heat of the burning cigarette while smoking.

Ash tray 4 is formed at the inner bottom part of the main body 1 and comes beneath the housing 6. While smoking, the ashes drop into the ash tray 4 automatically.

Cigarette holder/light extinguisher 5 is the portion formed at the end of the housing 6. It is approx. one inch in length and has opening at the top whereas the opening is narrower than the diameter of a cigarette or the width of the inner walls of the holder 6, and the said width of the inner walls of the holder 6 is apprx. the same with that of a cigarette, as shown in FIG. 3, so when a cigarette is squeezed into the holder 6 through the narrow opening, it holds the cigarette tight without hampering smooth combustion of the cigarette. When a cigarette is inserted or squeezed into the holder 6 for smoking, the end of the cigarette comes approx. one third of an inch front of the nozzle 8 of the lighter 2. And, when the burning ember of the cigarette reaches the entrance of the holder 5, the light goes off automatically because the cigarette is held tightly in the holder 5. Also, as the said opening of the holder 5 is narrower than the diameter of a cigarette, the cigarette in the holder 5 will not come off even if the pipe becomes upside down.

The housing 6 is a chamber wherein a cigarette is placed for smoking, therefore, it should be large enough to provide enough room around the cigarette, at least one tenth of an inch. The top portion is open so a cigarette is inserted therethrough and circulate air and smoke.

A pair of half moon shaped ditch 11 along the cigarette holder 5 are for to facilitate insertion of a cigarette into the holder 5. When the nichotine extractor 3 is attached to the holder 5 by means of a hinge these ditches 11 may be excluded.

The nichotine extractor 3 is attached at the end of the main body 1 as shown in FIG. 1 and FIG. 2, or a separately made nichotine extractor 12 or a conventional cigarette pipe may be connected to the filter of the cigarette, in lieu of the nichotine extractor 3, as shown in FIG. 5.

FIG. 4 shows a modification of the invention whereas the lighter 2 and nichotine extractor 3 being excluded and having a larger ash tray compartment.

FIG. 5 shows another modification of the invention whereas the nichotine extractor 3 is replaced by a separately made nichotine extractor 12 or a conventional cigarette pipe. These modifications are more suitable as a table ash tray and convenient for use by house wives while cooking. When the invention is used exclusively as an ash tray, the cigarette need not to be inserted into the holder 5, instead, the cigarette may be placed on the opening of the holder 5.

Having thus described the invention, it is to be understood that certain modifications in the construction and arrangement of the parts thereof will be made, as deemed necessary, without departing the spirit or scope of the appointed claims.

I claim:

1. A multi-purpose cigarette pipe for smoking a cigarette comprising a housing having a forward portion, a rear portion, and a middle portion connecting said forward and rear portion; said rear portion comprising a cigarette holder and associated with said holder is a means for extinguishing a cigarette; said middle portion having a means to collect ashes at the bottom of said middle portion; said housing opened at it top; means to light a cigarette in said housing attached to said forward portion; and a nicotine extractor located in said hollow.

2. A multi-purpose cigarette pipe as defined in claim 1 comprising an extinguishing means included therein.

* * * * *